US011128109B2

(12) United States Patent
Takahashi et al.

(10) Patent No.: US 11,128,109 B2
(45) Date of Patent: Sep. 21, 2021

(54) SPARK PLUG HAVING A PLURALITY OF GROUND ELECTRODES

(71) Applicant: NGK SPARK PLUG CO., LTD., Nagoya (JP)

(72) Inventors: Kei Takahashi, Nagoya (JP); Daisuke Kasahara, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/763,601

(22) PCT Filed: Jan. 18, 2019

(86) PCT No.: PCT/JP2019/001450

§ 371 (c)(1),
(2) Date: May 13, 2020

(87) PCT Pub. No.: WO2019/198295

PCT Pub. Date: Oct. 17, 2019

(65) Prior Publication Data

US 2020/0287359 A1 Sep. 10, 2020

(30) Foreign Application Priority Data

Apr. 11, 2018 (JP) ..... JP2018-075858

(51) Int. Cl.
*H01T 13/46* (2006.01)
*H01T 13/32* (2006.01)

(52) U.S. Cl.
CPC ..... *H01T 13/467* (2013.01); *H01T 13/32* (2013.01)

(58) Field of Classification Search
CPC ..... H01T 13/467; H01T 13/32; H01T 13/34; H01T 13/36
See application file for complete search history.

(56) References Cited

U.S. PATENT DOCUMENTS 5,210,458 A * 5/1993 McDougal ..... H01T 13/40 313/130
8,278,808 B2 * 10/2012 Lykowski ..... H01T 13/20 313/141

(Continued)

FOREIGN PATENT DOCUMENTS

CN 102074897 A 5/2011
CN 103493317 A 1/2014

(Continued)

OTHER PUBLICATIONS

International Search Report from corresponding International Patent Application No. PCT/JP2019/001450, dated Mar. 13, 2019.

(Continued)

*Primary Examiner* — Tracie Y Green
(74) *Attorney, Agent, or Firm* — Kusner & Jaffe

(57) ABSTRACT

A spark plug includes: a central electrode extending from a front end side to a rear end side along an axis; an insulator including a front end section formed to be a bottomed tube surrounding a tip of the central electrode; a metal shell shaped to be tubular and structured to support the insulator such that the front end section of the insulator projects to the front end side from a front end section of the metal shell; and a plurality of ground electrodes each of which includes a first end forming a discharge gap with the front end section of the insulator and includes a second end connected to the front end section of the metal shell. The plurality of ground electrodes include a pair of ground electrodes different from each other in size of their discharge gaps.

7 Claims, 4 Drawing Sheets

(56) References Cited

U.S. PATENT DOCUMENTS

| | | | | |
|---|---|---|---|---|
| 9,929,541 | B2 * | 3/2018 | Saito | H01T 13/52 |
| 2005/0134159 | A1 * | 6/2005 | Suzuki | H01T 13/467 313/141 |
| 2008/0284304 | A1 * | 11/2008 | Watanabe | H01T 13/52 313/141 |
| 2014/0015398 | A1 | 1/2014 | Sakakura et al. | |
| 2014/0210336 | A1 * | 7/2014 | Yamada | H01T 13/36 313/143 |
| 2016/0369764 | A1 * | 12/2016 | Ban | F02P 23/04 |

FOREIGN PATENT DOCUMENTS

| | | | |
|---|---|---|---|
| JP | 2010-037949 | A | 2/2010 |
| JP | 2017-045659 | A | 3/2017 |
| JP | 2017-152143 | A | 8/2017 |
| WO | WO 2017/110209 | A1 | 6/2017 |

OTHER PUBLICATIONS

Office Action dated Jan. 14, 2021, from related Chinese Patent Appl. No. CN 201980006511.5.

* cited by examiner

SPARK PLUG HAVING A PLURALITY OF GROUND ELECTRODES

FIELD OF THE INVENTION

The present invention relates to a spark plug, especially one utilizing barrier discharge.

BACKGROUND OF THE INVENTION

JP 2017-152143 A ("Patent Document 1)" discloses art for a spark plug utilizing barrier discharge, in which a tubular metal shell including a tubular front end (namely, a metal tube) serving as an electrode is disposed radially outside an insulator including a front end formed as a bottomed tube surrounding a central electrode, such that the metal tube of the metal shell faces the front end of the insulator with a space therebetween. The art according to Patent Document 1 includes arranging a central axis of the metal tube and a central axis of the front end of the insulator parallel with and apart from each other, in order to generate electric field circumferentially unhomogeneous in intensity, between the metal tube and the front end of the insulator. This serves to activate plasma at a spot at which the electric field is intense, and facilitate generation of initial flame.

However, according to the conventional art described above, the metal tube of the metal shell surrounds the front end of the insulator all over a circumference thereof. This may cause a problem that the initial flame disappears due to flame-extinguishing effect in which the metal tube takes away energy from the initial flame generated between the metal tube and the front end of the insulator, or a problem that the metal tube disturbs growth of flame.

SUMMARY OF THE INVENTION

In order to solve the problems, it is desirable to provide a spark plug structured to facilitate generation of initial flame and growth of flame, according to the present invention.

Means for Solving the Problem(s)

In view of the foregoing, according to a first aspect of the present invention, a spark plug comprising: a central electrode extending from a front end side to a rear end side along an axis; an insulator including a front end section formed to be a bottomed tube surrounding a tip of the central electrode; a metal shell shaped to be tubular and structured to support the insulator such that the front end section of the insulator projects to the front end side from a front end section of the metal shell; and a plurality of ground electrodes each of which includes a first end forming a discharge gap with the front end section of the insulator and includes a second end connected to the front end section of the metal shell, wherein the plurality of ground electrodes include a pair of ground electrodes different from each other in size of their discharge gaps.

Effect(s) of the Invention

According to the first aspect of the spark plug, each of the plurality of ground electrodes includes the first end connected to the front end section of the metal shell, and the second end forming the discharge gap with the front end section of the insulator. Thus-configured spark plug forms a gap between adjacent two of the ground electrodes, and thereby serves to reduce flame-extinguishing effect of the ground electrodes and facilitate generation of initial flame, and facilitate growth of flame.

The plurality of ground electrodes include the pair of ground electrodes different from each other in size of their discharge gaps. Accordingly, for example, when it is hard to induce discharge due to a high pressure in a combustion chamber, a smaller one of the discharge gaps allows the induction of discharge therein. This serves to facilitate the generation of initial flame. On the other hand, when it is easy to induce discharge due to a low pressure in the combustion chamber, a larger one of the discharge gap allows the induction of discharge therein. This serves to facilitate the growth of flame. Thus, the spark plug includes the discharge gaps compliant to a state of pressure in the combustion chamber. This serves to simultaneously achieve stabilization of the generation of initial flame and improvement of ignition performance.

According to the second aspect of the spark plug as claimed m claim 2, any pair of ground electrodes out of the plurality of ground electrodes are different from each other in size of their discharge gaps. This serves to facilitate induction of discharge in one of the discharge gaps, independently of the pressure in the combustion chamber. On the other hand, in case that the plurality of ground electrodes include a pair of ground electrodes same with each other in size of their discharge gaps, such pair of ground electrodes has no contribution to the improvement of ignition performance, and takes away energy of flame which may result in increase in loss. Thus, the second aspect of the spark plug serves to reduce the energy loss due to the ground electrodes while improving the ignition performance, in addition to the effects due to the first aspect of the spark plug.

According to a third aspect of the spark plug, the pair of ground electrodes different from each other in size of their discharge gaps are different from each other in position of their first ends in a direction of the axis. In case that a pair of the first ends are arranged to be same with each other in position in the direction of the axis and are different from each other in size of the discharge gaps each of which is formed between the corresponding one of the first ends and the front end section of the insulator, the discharge tends to be induced more frequently in a smaller one of the discharge gaps. To avoid this, by arranging the pair of ground electrodes different from each other in size of their discharge gaps as different from each other in position of their first ends in the direction of the axis, the induction of discharge is facilitated not only in a smaller one of the discharge gaps but also in a larger one of the discharge gaps. This serves to further facilitate the growth of flame, in addition to the effects due to the first or second aspects of the spark plug.

According to a fourth aspect of the spark plug, the discharge gaps include a pair of discharge gaps formed such that a front-end-side one of the pair of discharge gaps is larger than a rear-end-side one of the pair of discharge gaps. This serves to facilitate the growth of flame more in the front-end-side discharge gap than in the rear-end-side discharge gap, wherein the front-end-side discharge gap is nearer to a center of the combustion chamber than the rear-end-side discharge gap. This serves to facilitate combustion of air-fuel mixture in the combustion chamber due to the facilitated growth of flame, in addition to the effects due to the third aspect of the spark plug.

According to a fifth aspect of the spark plug, the discharge gaps include a pair of discharge gaps formed such that a front-end-side one of the pair of discharge gaps is smaller than a rear-end-side one of the pair of discharge gaps. This serves to facilitate the generation of initial flame more in the front-end-side discharge gap than in the rear-end-side discharge gap, wherein the front-end-side discharge gap is nearer to a center of the combustion chamber than the rear-end-side discharge gap. This serves to facilitate combustion of air-fuel mixture in the combustion chamber due to the facilitated generation of initial flame, in addition to the effects due to the third aspect of the spark plug.

According to a sixth aspect of the spark plug, the pair of ground electrodes different from each other in size of their discharge gaps are arranged such that the first ends of the pair of ground electrodes are apart from each other by 80° or greater in angle around the axis. This serves to facilitate the induction of discharge not only in a smaller one of the discharge gaps but also in a larger one of the discharge gaps. This serves to facilitate the growth of flame due to discharge in the larger one of the discharge gaps, in addition to the effects due to any one of the first to fifth aspects of the spark plug.

According to a seventh aspect of the spark plug, the plurality of ground electrodes are composed of two electrodes. This serves to maximally reduce the energy loss due to the ground electrodes while improving the ignition performance, in addition to the effects due to any one of the first to sixth aspects of the spark plug.

DETAILED DESCRIPTION OF THE INVENTION

Figure 1:
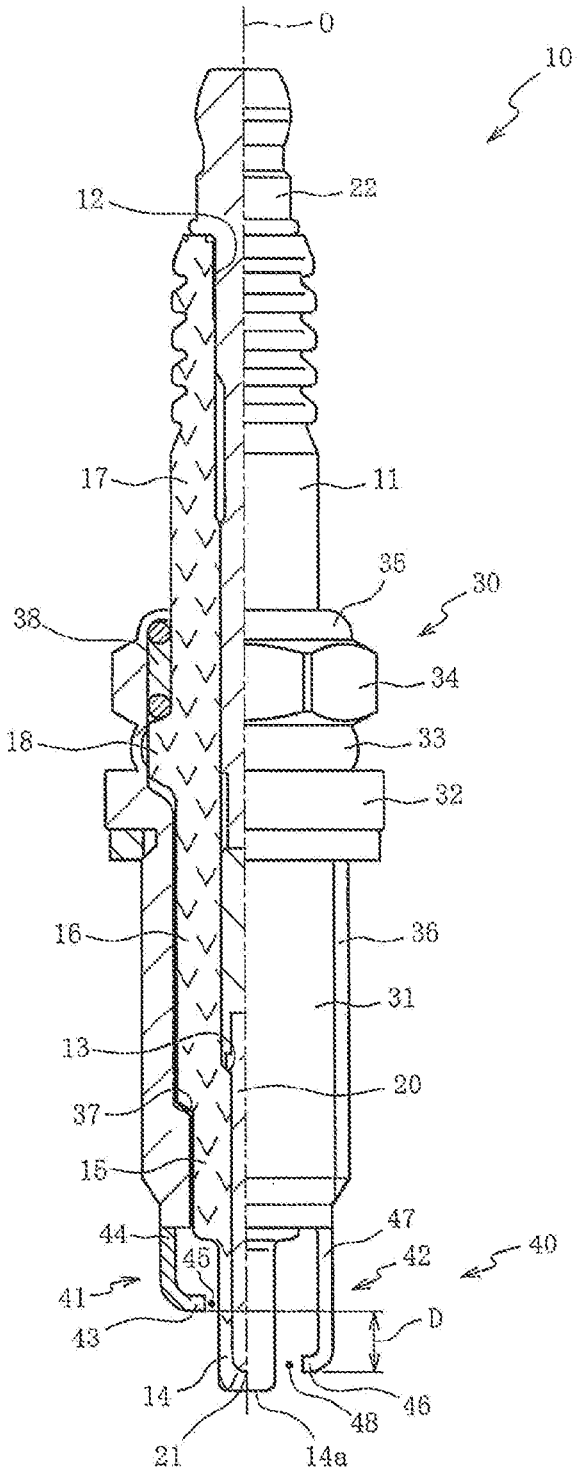
FIG. 1 is a half sectional view of a spark plug according to a first embodiment.

The following describes exemplary embodiments of the present invention, with reference to the attached drawings. FIG. 1 is a half sectional view of a spark plug 10 according to a first embodiment, wherein the spark plug 10 has an axis O serving as a border of the half sectional view. In FIG. 1, a lower side in the drawing is referred to as a front end side of the spark plug 10, and an upper side in the drawing is referred to as a rear end side of the spark plug 10. This is same for FIGS. 3A, 3B, 4A, and 4B. As shown in FIG. 1, the spark plug 10 includes an insulator 11, a central electrode 20, a metal shell 30, and ground electrodes 40.

The insulator 11 is a bottomed tubular member made of alumina sufficient in insulation performance and mechanical characteristics under high temperature. The insulator 11 includes a hole 12 extending along the axis O and having a circular cross section. The hole 12 is open at a rear end of the insulator 11, and is closed at a front end of the insulator 11. The insulator 11 includes in its inner periphery a rearward-directed face 13 disposed in a front-end-side section of the hole 12 and formed all over a circumference thereof. The rearward-directed face 13 is structured to engage with a rear-end-side portion of the central electrode 20 in order to retain it.

The central electrode 20 is a cylindrical electrode made of conductive metal such as nickel-base alloy, which extends along the axis O in the hole 12. The spark plug 10 further includes a metal terminal 22 that is a rod member structured to receive an alternating-current voltage or a pulse voltage and made of conductive metal such as low-carbon steel. The metal terminal 22 is fixed to the rear end of the insulator 11 such that a front-end-side section of the metal terminal 22 is disposed in the hole 12 and is electrically connected to the central electrode 20 via a connection part 23 made of material such as conductive glass.

The insulator 11 includes a front end section 14, a small-diameter section 15, a large-diameter section 16, a rear end section 17, and an overhang 18. The front end section 14 is formed as a bottomed tube surrounding a tip 21 of the central electrode 20. The small-diameter section 15 is shaped tubular and disposed adjacent to the front end section 14 from the rear end side. The large-diameter section 16 is shaped tubular and disposed adjacent to the small-diameter section 15 from the rear end side. The rear end section 17 is shaped tubular and disposed adjacent to the large-diameter section 16 from the rear end side. The overhang 18 is formed between the large-diameter section 16 and the rear end section 17 all over a circumference thereof, so as to overhang radially outwardly from outer peripheries of the large-diameter section 16 and the rear end section 17.

The front end section 14 surrounds a front-end-side section of the central electrode 20, and is closed at a tip 14*a* thereof, and is shaped to be a cylindrical tube constant in outer diameter all over a length thereof in the direction of axis O, according to the present embodiment. The small-diameter section 15 surrounds a central section of the central electrode 20, and is shaped to be a cylindrical tube constant in outer diameter all over a length thereof in the direction of axis O, according to the present embodiment. The small-diameter section 15 is greater in outer diameter than the front end section 14. The large-diameter section 16 surrounds a rear-end-side section of the central electrode 20, and is shaped to be a cylindrical tube constant in outer diameter all over a length thereof in the direction of axis O, according to the present embodiment. The large-diameter section 16 is greater in outer diameter than the small-diameter section 15.

The metal shell 30 is a substantially cylindrical tubular member made of conductive metal such as low-carbon steel. The metal shell 30 includes: a front end section 31 surrounding the insulator 11 in a region from the small-diameter section 15 to a part of the large-diameter section 16; a seat section 32 disposed adjacent to the front end section 31 from the rear end side; a connection section 33 disposed adjacent to the seat section 32 from the rear end side; a tool engagement section 34 disposed adjacent to the connection section 33 from the rear end side; and a rear end section 35 disposed adjacent to the tool engagement section 34 from the rear end side.

The front end section 31 includes in its outer periphery an external screw 36 structured to be screwed into a screw hole of an engine not shown, and includes in its inner periphery a rearward-directed face 37 formed all over a circumference thereof. The rearward-directed face 37 of the front end section 31 is positioned frontward with respect to the large-diameter section 16 of the insulator 11. The seat section 32 is structured to close a gap between the screw hole of the engine and the external screw 36, and is formed greater in outer diameter than the front end section 31. The connection section 33 is a section plasticly deformed to be curved upon installation of the metal shell 30 to the insulator 11. The tool engagement section 34 is a section with which a tool such as a wrench engages upon the screw-in of the external screw 36 to the screw hole of the engine. The rear end section 35 is bent radially inwardly, and is positioned rearward with respect to the overhang 18 of the insulator 11.

Between the rear end section 35 and the overhang 18, a seal 38 filled with powder such as talc is formed all over a circumference of an outer periphery of the rear end section 17 of the insulator 11. Via the seal 38, a section of the metal shell 30 from the rearward-directed face 37 to the rear end section 35 exerts a compressive load in the direction of axis O to a section of the insulator 11 from the large-diameter section 16 to the overhang 18. Thus, the metal shell 30 supports the insulator 11. The rearward-directed face 37 of the inner periphery of the metal shell 30 retains the large-diameter section 16 of the insulator 11 from the front end side, and the front end section 14 and a part of the small-diameter section 15 of the insulator 11 projects from the front end section 31 of the metal shell 30 to the front end side.

The ground electrodes 40 are rod members made of metal such as nickel-base alloy and joined to the front end section 31 of the metal shell 30. According to the present embodiment, the ground electrodes 40 are composed of a first electrode 41 and a second electrode 42 each of which has a rectangular cross section and extends in the direction of axis O.

The first electrode 41 includes a first end 43 and a second end 44 wherein the first end 43 is positioned frontward with respect to the second end 44 connected to the metal shell 30. According to the present embodiment, the first electrode 41 is disposed parallel with the axis O, except for the first end 43. The first end 43 is bent toward the front end section 14 of the insulator 11, and is less in distance to the front end section 14 than the other portions of the first electrode 41. The first end 43 of the first electrode 41 and the front end section 14 of the insulator 11 form a discharge gap 45 therebetween.

The second electrode 42 includes a first end 46 and a second end 47 wherein the first end 46 is positioned frontward with respect to the second end 47 connected to the metal shell 30. According to the present embodiment, the second electrode 42 is disposed parallel with the axis O, except for the first end 46. The first end 46 is bent toward the front end section 14 of the insulator 11, and is less in distance to the front end section 14 than the other portions of the second electrode 42. The first end 46 of the second electrode 42 and the front end section 14 of the insulator 11 form a discharge gap 45 therebetween.

The first end 43 of the first electrode 41 and the first end 46 of the second electrode 42 are positioned 180° apart from each other in angle measured around the axis O. The first end 46 of the second electrode 42 is positioned forward with respect to the first end 43 of the first electrode 41. The discharge gap 48 formed with the second electrode 42 is greater in size than the discharge gap 45 formed with the first electrode 41, wherein the size of discharge gap 45 or 48 means the shortest distance from the front end section 14 to the first end 43 or 46 respectively.

In response to application of an alternating-current voltage or a pulse voltage between the metal terminal 22 and the metal shell 30 of the spark plug 10 mounted to the engine not shown, the front end section 14 of the insulator 11 and the ground electrodes 40 have non-equilibrium plasma (streamer discharge) generated therebetween. The non-equilibrium plasma causes few conversion to thermal energy and therefore causes few raise in temperature of combustible air-fuel mixture in a combustion chamber not shown, but produces electrons with high energy. Collision among the high-energy electrons produces radicals of O, N, OH, etc. in large quantities. Then, temperature rise due to exothermic reaction and chain reaction by the radicals proceed to cause ignition and generate an initial flame in a reaction region having a certain volume which includes the discharge gaps 45 and 48. The initial flame grows to lead the combustible air-fuel mixture to combustion.

The discharge gaps 45 and 48 of the first electrode 41 and the second electrode 42 of the ground electrodes 40 are different from each other in size. Accordingly, for example, when it is hard to induce discharge due to a high pressure in the combustion chamber, the small discharge gap 45 allows the induction of discharge therein. When it is easy to induce discharge due to a low pressure in the combustion chamber, the large discharge gap 48 allows the induction of discharge therein. The small discharge gap 45 facilitates the induction of discharge therein, and serves to stabilize the generation of initial flame over increase in pressure in the combustion chamber. The large discharge gap 48 has a large reaction region, and thereby serves to facilitate growth of flame and improve ignition performance. This serves to simultaneously achieve the stable generation of initial flame and the improvement of ignition performance.

The ground electrodes 40 are composed of the first electrode 41 and the second electrode 42 that are connected to the metal shell 30 and are arranged at an interval in a circumferential direction of the metal shell 30. Thus, the first electrode 41 and the second electrode 42 have therebetween a gap in the circumferential direction. This secures certain spaces available as reaction regions respectively around the first electrode 41 and the second electrode 42, wherein the spaces respectively include the discharge gaps 45 and 48. This serves to suppress flame-extinguishing effect of the ground electrodes 40, and facilitate the generation of initial flame and the growth of flame.

The different sizes of the discharge gaps 45 and 48 of the first electrode 41 and the second electrode 42 of the ground electrodes 40 serve to facilitate the induction of discharge in one of the discharge gaps 45 and 48, independently of a pressure in the combustion chamber. The ground electrodes 40 include no pair of ground electrodes same with each other in size of the discharge gaps. This allows exclusion of a ground electrode that has no contribution to the improvement of ignition performance and takes away energy from the flame. This serves to reduce energy loss due to the ground electrodes 40, simultaneously with the improvement of ignition performance. In particular, since the ground electrodes 40 include two ground electrodes of the first electrode 41 and the second electrode 42, the energy loss due to the ground electrodes 40 can be maximally reduced while improving the ignition performance.

Each of the first end 43 of the first electrode 41 and the first end 46 of the second electrode 42 is formed to bent toward the front end section 14 of the insulator 11. This serves to concentrate electric field on the first ends 43 and 46, and thereby facilitates the induction of discharge between the first end 43 and the front end section 14 and between the first end 46 and the front end section 14.

The following describes how a position of the first end 43 of the first electrode 41 with respect to the first end 46 of the second electrode 42 influences the discharge of the second electrode 42 in the discharge gap 48, with reference to FIG.

Figure 2A:
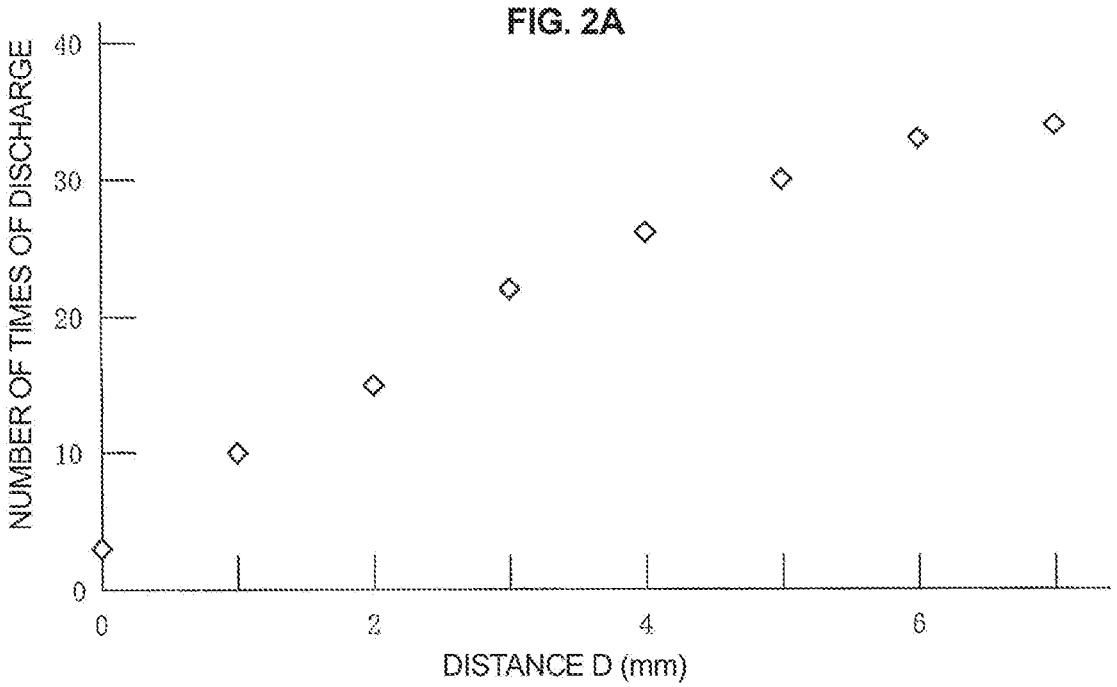
FIG. 2A is a chart showing a relation of a number of times of discharge to a distance between ground electrodes in a direction of an axis.

2A. FIG. 2A is a chart showing a relation of a number of times of discharge in the discharge gap 48 to a distance D (see FIG. 1) between the first ends 43 and 46 of the ground electrodes 40 in the direction of axis O of the spark plug 10.

FIG. 2A shows a result of experiment including: fixing a position of the first end 46 of the second electrode 42; moving a position of the first end 43 of the first electrode 41 with respect to the first end 46, by 1 mm increments to the rear end side; and preparing eight samples of the spark plug 10 in which the distance D between the first ends 43 and 46 in the axial direction varies from 0 mm to 7 mm. Each of the samples was formed such that: the first end 43 of the first electrode 41 and the first end 46 of the second electrode 42 were 180° apart from each other in angle around the axis O: the size (i.e. the shortest distance in the radial direction) of the discharge gap 48 at the second electrode 42 was 2 mm; and the size of the discharge gap 45 at the first electrode 41 was 0.5 mm. The samples were same with each other in dimension, shape, material, etc. except for distance D.

Each of the samples was mounted to a chamber (not shown) including an observation window. The chamber was filled with test gas that was air in the present embodiment. While a pressure inside the chamber was maintained at 0.4 MPa, a pulse voltage was applied between the metal terminal 22 and the metal shell 30. The pulse voltage had a repetition frequency of 40 kHz and a voltage magnitude of 20 kV. The discharge was observed by a high speed camera, in order to count the number of times of discharge in the discharge gap 48 out of a total of 100 times of discharge induced in the discharge gap 45 or 48. FIG. 2A has a horizontal axis representing the distance D (mm) between the first end 43 of the first electrode 41 and the first end 46 of the second electrode 42 in the axial direction, and a vertical axis representing the number of times of discharge 100 times) in the discharge gap 48 of the second electrode 42.

As shown in FIG. 2A, the number of times of discharge in the discharge gap 48 increased with increase in distance D. The experiment showed that 10% of discharge in the discharge gap 45 or 48 was induced in the discharge gap 48 when the distance D was equal to or greater than 1 mm.

Accordingly, as shown in FIG. 2A, the induction of discharge can be facilitated not only in the small discharge gap 45 easy to discharge but also in the large discharge gap 48, by forming the discharge gaps 45 and 48 different from each other in size, respectively between the first end 43 of the first electrode 41 and the front end section 14 and between the first end 46 of the second electrode 42 and the front end section 14, such that the first ends 43 and 46 are different from each other in position in the axial direction: i.e., such that the distance D is not equal to 0. This serves for the stable generation of initial flame in the discharge gap 45, and for the growth facilitation of flame due to the discharge in the large discharge gap 48.

Furthermore, the spark plug 10 is formed such that the discharge gap 48 being a front-end-side one of the discharge gaps is larger than the discharge gap 45 being a rear-end-side one of the discharge gaps. This allows the reaction region including the discharge gap 48 to be larger than the reaction region including the discharge gap 45. This facilitates the growth of flame in the front-end-side discharge gap 48 nearer to the combustion chamber not shown than the rear-end-side discharge gap 45, and thereby facilitates the combustion of air-fuel mixture in the combustion chamber due to a grown flame.

Figure 2B:
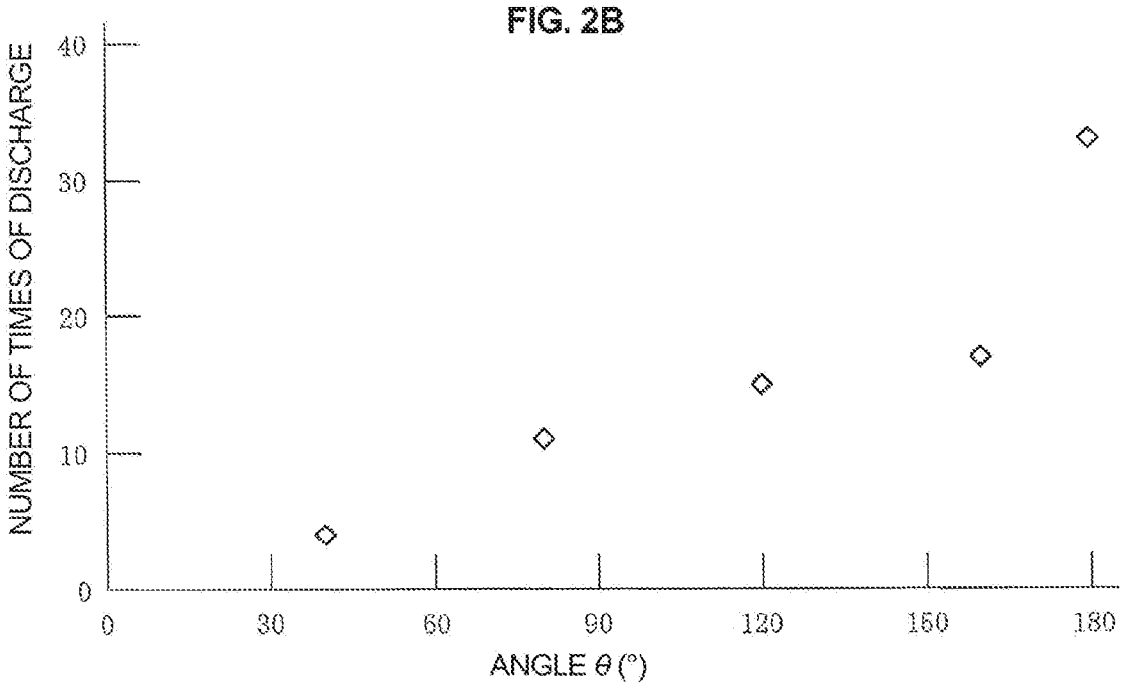
FIG. 2B is a chart showing a relation of a number of times of discharge to an angle between the ground electrodes which is measured as around the axis.

Next, the following describes how an angle θ between the first end 43 of the first electrode 41 and the first end 46 of the second electrode 42 which is measured as around the axis O influences the discharge in the discharge gap 48 of the second electrode 42. FIG. 2B is a chart showing a relation of the number of times of discharge in the discharge gap 48 to the angle θ (measured as an acuter one) between the first ends 43 and 46 of the ground electrodes 40 around the axis O.

FIG. 2B shows a result of experiment with five samples of the spark plug 10 which vary in angle θ between the first end 43 of the first electrode 41 and the first end 46 of second electrode 42 around the axis O. The five samples respectively had the angles θ (the acuter ones) of 40°, 80°, 120°, 160°, and 180°. Each of the samples was formed such that: the size (i.e. the shortest distance in the radial direction) of the discharge gap 48 at the second electrode 42 was 2 mm; the size of the discharge gap 45 at the first electrode 41 was 0.5 mm; the first end 43 of the first electrode 41 was positioned rearward with respect to the first end 46 of the second electrode 42; and the distance D between the first end 43 of the first electrode 41 and the first end 46 of the second electrode 42 in the axial direction was 6 mm. The samples were same with each other in dimension, shape, material, etc. except for angle θ.

Each of the samples was mounted to a chamber (not shown) including an observation window. While the pressure inside the chamber filled with the test gas (air) was maintained at 0.4 MPa, the pulse voltage was applied between the metal terminal 22 and the metal shell 30. The pulse voltage had the repetition frequency of 40 kHz and the voltage magnitude of 20 kV. The discharge was observed by the high speed camera, in order to count the number of times of discharge in the discharge gap 48 out of a total of 100 times of discharge induced in the discharge gap 45 or 48. FIG. 2B has a horizontal axis representing the angle θ (°) between the first ends 43 and 46 of the ground electrodes 40 around the axis O, and a vertical axis representing the number of times of discharge 100 times) in the discharge gap 48 of the second electrode 42.

As shown in FIG. 2B, the number of times of discharge in the discharge gap 48 increased with increase in angle θ. The experiment showed that 10% of discharge in the discharge gap 45 or 48 was induced in the discharge gap 48 when the angle θ was equal to or greater than 80°.

Accordingly, as shown in FIG. 2B, the induction of discharge can be facilitated not only in the small discharge gap 45 easy to discharge but also in the large discharge gap 48, by forming the first end 43 of the first electrode 41 and the first end 46 of the second electrode 42 different from each other in size of the discharge gaps 45 and 48, such that the first ends 43 and 46 are 180° apart from each other in angle measured as around the axis O (where the angle θ≥80°. This serves for the stable generation of initial flame in the discharge gap 45, and for the growth facilitation of flame due to the discharge in the large discharge gap 48.

Figure 3A:
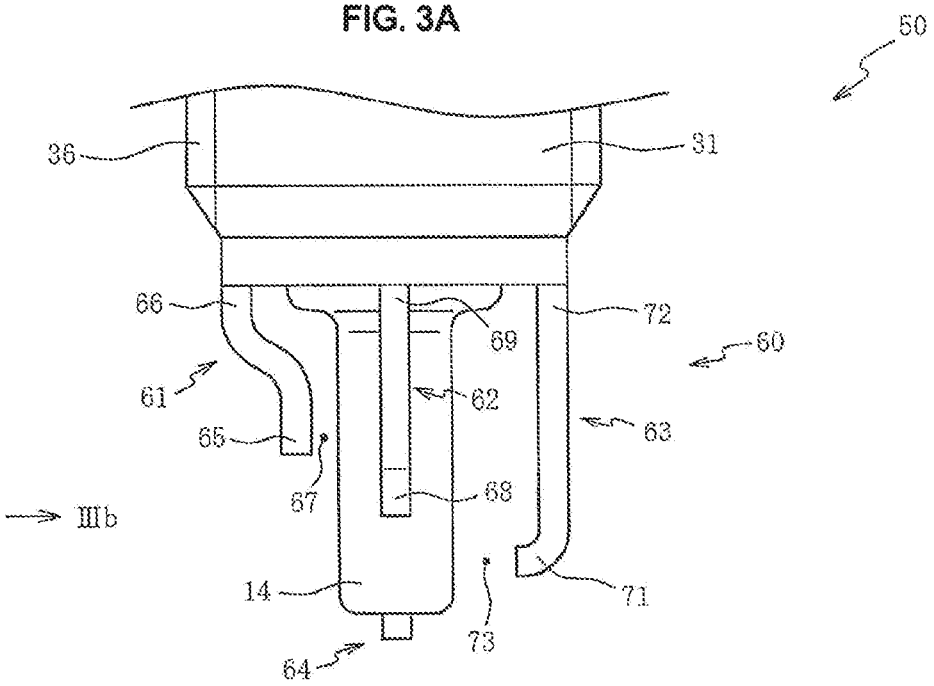
FIG. 3A is a side view of a spark plug according to a second embodiment.
Figure 3B:
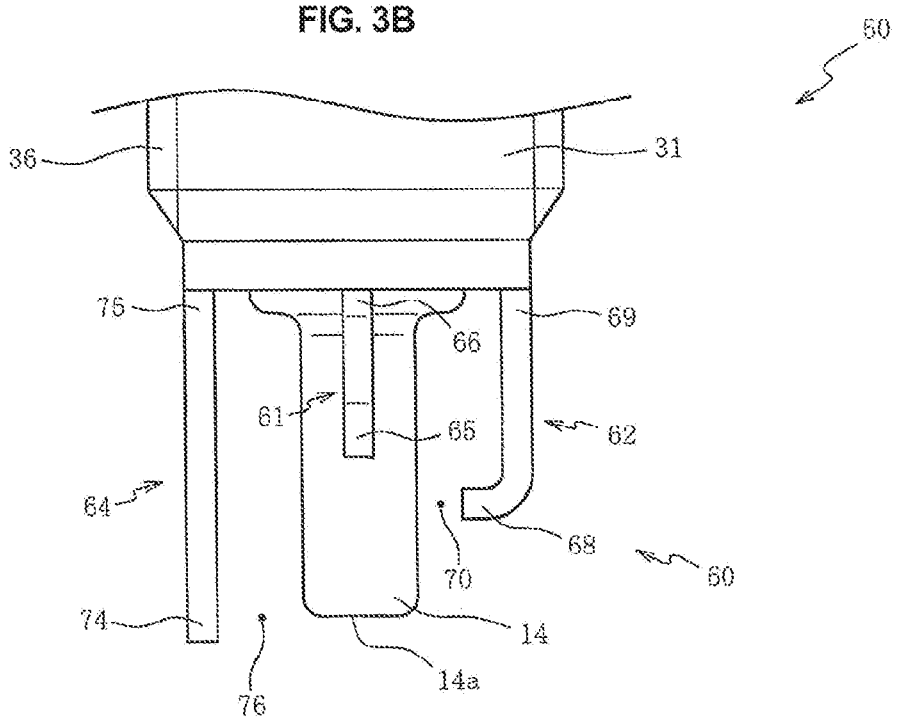
FIG. 3B is a side view of the spark plug viewed in a direction of an arrow IIIb shown in FIG. 3A.

The following describes a second embodiment with reference to FIGS. 3A and 3B. The first embodiment exemplifies a case in which a number of the ground electrodes 40 is two. As a variation, the second embodiment exemplifies a case in which a number of ground electrodes 60 is four. The configurations common to the first embodiment are represented by the common reference numerals for simplification of description.

Figure 4A:
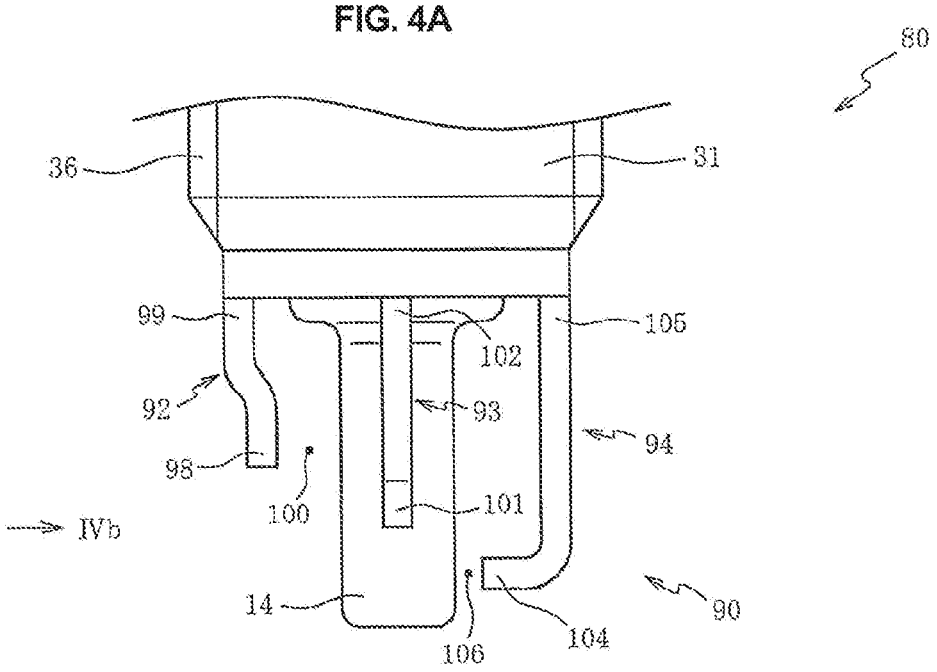
FIG. 4A is a side view of a spark plug according to a third embodiment.
Figure 4B:
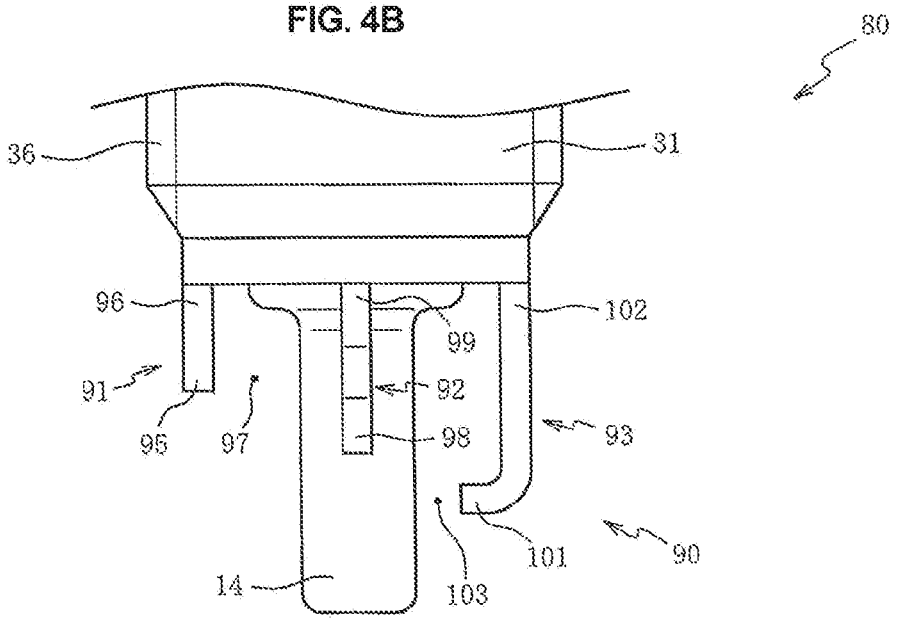
FIG. 4B is a side view of the spark plug viewed in a direction of an arrow IVb shown in FIG. 4A.

FIG. 3A is a side view of a spark plug 50 according to the second embodiment. FIG. 3B is a side view of the spark plug 50 viewed in a direction of an arrow IIIb shown in FIG. 3A. Each of FIGS. 3A and 3B is drawn omitting its rear-end-side section, and each of FIGS. 4A and 4B is drawn similarly.

As shown in FIGS. 3A and 3B, the spark plug 50 includes the ground electrodes 60 each of which is a rod member made of metal such as nickel-base alloy and is connected to the front end section 31 of the metal shell 30 (see FIG. 1). The ground electrodes 60 are composed of a first electrode 61, a second electrode 62, a third electrode 63, and a fourth electrode 64 each of which has a rectangular cross section and is disposed parallel with the axis O.

The first electrode 61 includes a first end 65 and a second end 66, wherein the first end 65 is positioned frontward with respect to the second end 66 connected to the metal shell 30. The first electrode 61 includes an axially central section bent toward the front end section 14 of the insulator 11, with the first end 65 and its vicinity extending parallel with the axis O. The first end 65 and its vicinity are less in distance to the front end section 14 of the insulator 11 than the other portions of the first electrode 61, and thus form a discharge gap 67 with the front end section 14. Such disposition of the first end 65 and its vicinity parallel with the axis O serves to induce discharge at dispersed points in the discharge gap 67, and thereby expand a reaction region for the generation of initial flame.

The second electrode 62 includes a first end 68 and a second end 69, wherein the first end 68 is positioned frontward with respect to the second end 69 connected to the metal shell 30. The second electrode 62 extends parallel with the axis O, except for the first end 68. The first end 68 is bent toward the front end section 14 of the insulator 11, and is less in distance to the front end section 14 than the other portions of the second electrode 62. The first end 68 of the second electrode 62 forms a discharge gap 70 with the front end section 14 of the insulator 11.

The third electrode 63 includes a first end 71 and a second end 72, wherein the first end 71 is positioned frontward with respect to the second end 72 connected to the metal shell 30. The third electrode 63 extends parallel with the axis O, except for the first end 71. The first end 71 is bent toward the front end section 14 of the insulator 11, and is less in distance to the front end section 14 than the other portions of the third electrode 63. The first end 71 of the third electrode 63 forms a discharge gap 73 with the front end section 14 of the insulator 11.

The fourth electrode 64 includes a first end 74 and a second end 75, wherein the first end 74 is positioned frontward with respect to the second end 75 connected to the metal shell 30. The fourth electrode 64 extends parallel with the axis O. In the fourth electrode 64, the first end 74 is to be a point of concentration of electric field. This causes discharge to tend to be induced between the first end 74 and the front end section 14. Thus, the first end 74 of the fourth electrode 64 forms a discharge gap 76 with the front end section 14 of the insulator 11. The first end 74 of the fourth electrode 64 is positioned frontward with respect to the tip 14*a* of the front end section 14.

The first end 65 of the first electrode 61, the first end 68 of the second electrode 62, the first end 71 of the third electrode 63, and the first end 74 of the fourth electrode 64 are arranged at 90° intervals in angle around the axis O. Furthermore, the first end 65 of the first electrode 61, the first end 68 of the second electrode 62, the first end 71 of the third electrode 63, and the first end 74 of the fourth electrode 64 are positioned in this order, in a direction from the rear end side to the front end side of the spark plug 50. The first ends 65, 68, 71, and 74 are in this order also in view of sizes of their discharge gaps 67, 70, 73, and 76 from smallest to largest. The size of the discharge gap 76 means the shortest distance from the first end 74 and its vicinity to the front end section 14.

The spark plug 50 includes the first end 65 of the first electrode 61, the first end 68 of the second electrode 62, the first end 71 of the third electrode 63, and the first end 74 of the fourth electrode 64 arranged at the 90° intervals in angle around the axis O (where the angle $\theta \geq 80°$, wherein their discharge gaps 67, 70, 73, and 76 are different from each other in size. This serves to facilitate discharge not only in the small discharge gap 67 easy to discharge but also in the discharge gaps 70, 73, and 76 larger than the discharge gap 67, and thereby facilitate the growth of flame due to the discharge induced in the discharge gaps 70, 73, and 76.

Furthermore, the spark plug 50 is formed such that the discharge gap 76 is larger than the discharge gap 67 positioned rearward with respect to the discharge gap 76. This facilitates the growth of flame more in the discharge gap 76 than in the discharge gap 67, wherein the discharge gap 76 is nearer to a center of the combustion chamber not shown than the discharge gap 67. This serves to facilitate the combustion of air-fuel mixture in the combustion chamber due to a grown flame.

The following describes a third embodiment with reference to FIGS. 4A and 4B. Each of the first embodiment and the second embodiment exemplifies a case in which one of the discharge gaps is larger than another of the discharge gaps positioned rearward with respect to the one of the discharge gaps. In contrast, the third embodiment exemplifies a case in which one of the discharge gaps is smaller than another of the discharge gaps positioned rearward with respect to the one of the discharge gaps. The configurations common to the first embodiment are represented by the common reference numerals for simplification of description. FIG. 4A is a side view of a spark plug 80 according to the third embodiment. FIG. 4B is a side view of the spark plug 80 viewed in a direction of an arrow IVb shown in FIG. 4A.

As shown in FIGS. 4A and 4B, the spark plug 80 includes ground electrodes 90 each of which is a rod member made of metal such as nickel-base alloy and is connected to the front end section 31 of the metal shell 30 (see FIG. 1). The ground electrodes 90 are composed of a first electrode 91, a second electrode 92, a third electrode 93, and a fourth electrode 94 each of which has a rectangular cross section and is disposed parallel with the axis O.

The first electrode 91 includes a first end 95 and a second end 96, wherein the first end 95 is positioned frontward with respect to the second end 96 connected to the metal shell 30. The first electrode 91 extends parallel with respect to the axis O. In the first electrode 91, the first end 95 is to be a point of concentration of electric field. This causes discharge to tend to be induced between the first end 95 and the front end section 14 of the insulator 11. Thus, the first end 95 of the first electrode 91 forms a discharge gap 97 with the front end section 14 of the insulator 11.

The second electrode 92 includes a first end 98 and a second end 99, wherein the first end 98 is positioned frontward with respect to the second end 99 connected to the metal shell 30. The second electrode 92 includes an axially central section bent toward the front end section 14 of the insulator 11, with the first end 98 and its vicinity extending parallel with the axis O. The first end 98 and its vicinity are less in distance to the front end section 14 of the insulator 11 than the other portions of the second electrode 92, and thus form a discharge gap 100 with the front end section 14. Such disposition of the first end 98 and its vicinity parallel with the axis O serves to induce discharge at dispersed points in the discharge gap 100, and thereby expand a reaction region for the generation of initial flame.

The third electrode 93 includes a first end 101 and a second end 102, wherein the first end 101 is positioned frontward with respect to the second end 102 connected to the metal shell 30. The third electrode 93 extends parallel with the axis O, except for the first end 101. The first end 101 is bent toward the front end section 14 of the insulator 11, and is less in distance to the front end section 14 than the other portions of the third electrode 93. The first end 101 of the third electrode 93 forms a discharge gap 103 with the front end section 14 of the insulator 11.

The fourth electrode 94 includes a first end 104 and a second end 105, wherein the first end 104 is positioned frontward with respect to the second end 105 connected to the metal shell 30. The fourth electrode 94 extends parallel with the axis O, except for the first end 104. The first end 104 is bent toward the front end section 14 of the insulator 11, and is less in distance to the front end section 14 than the other portions of the fourth electrode 94. The first end 104 of the fourth electrode 94 forms a discharge gap 106 with the front end section 14 of the insulator 11.

The first end 95 of the first electrode 91, the first end 98 of the second electrode 92, the first end 101 of the third electrode 93, and the first end 104 of the fourth electrode 94 are arranged at 90° intervals in angle around the axis O. Furthermore, the first end 95 of the first electrode 91, the first end 98 of the second electrode 92, the first end 101 of the third electrode 93, and the first end 104 of the fourth electrode 94 are positioned in this order in a direction from the rear end side to the front end side. The first ends 95, 98, 101, and 104 are in this order also in view of sizes of their discharge gaps 97, 100, 103, and 106 from largest to smallest. The size of the discharge gap 97 means the shortest distance from the first end 95 and its vicinity to the front end section 14. The size of the discharge gap 100 means the shortest distance from the first end 98 and its vicinity to the front end section 14.

The spark plug 80 is formed such that the discharge gap 106 is smaller than the discharge gap 97 positioned rearward with respect to the discharge gap 106. This facilitates the generation of initial flame more in the discharge gap 106 than in the discharge gap 97, wherein the discharge gap 106 is nearer to the center of the combustion chamber not shown than the discharge gap 97. This serves to facilitate ignition of air-fuel mixture in the combustion chamber due to facilitated generation of initial flame.

While the above describes the present invention on the basis of the embodiments, the present invention is not limited to the above embodiment. The present invention naturally includes any improvement and/or modification within scope of the present invention.

Although according to the embodiments the number of the ground electrodes is two or four, the present invention is not limited to that. The number of the ground electrodes may be appropriately modified, and naturally may be three, five, or other greater number.

Although according to the embodiments the discharge gaps between the front end section 14 of the insulator 11 and the ground electrodes 40, 60, or 90 are different from each other in size, the present invention is not limited to that. The discharge gaps may include a pair of discharge gaps same with each other in size. Provided that the ground electrodes include a pair of ground electrodes different from each other in size of their discharge gaps, the induction of discharge is facilitated in one of such discharge gaps different from each other in size, independently of the pressure in the combustion chamber.

Although according to the embodiments the front end section 14 of the insulator 11 is constant in outer diameter all over the axial length thereof, the present invention is not limited to that. For example, the outer periphery of the front end section 14 may be shaped to decrease in diameter as going to the front end side such that the front end of the front end section 14 is less in outer diameter than the rear end of the front end section 14. In another manner, the outer periphery of the front end section 14 may be shaped to increase in diameter as going to the front end side such that the front end of the front end section 14 is greater in outer diameter than the rear end of the front end section 14. In still another manner, the outer periphery of the front end section 14 may be shaped as a cylindrical tube including a bulging central section such that the front end section 14 includes an axial central section greater in outer diameter than the front end or the rear end of the front end section 14. It is allowed to appropriately adjust intensity of electric field between the central electrode and the ground electrodes by changing a shape of the outer periphery of the front end section 14 of the insulator 11, depending on a radial thickness of the front end section 14 etc.

Although according to the embodiments the tip 14*a* of the front end section 14 of the insulator 11 is flat, the present invention is not limited to that. For example, the tip 14*a* may be shaped as a spherical crown.

Although according to the embodiments each electrode of the ground electrodes 40, 60, and 90 is formed linearly and includes the second end and its vicinity disposed to extend parallel with the axis O, the present invention is not limited to that. Each electrode of the ground electrodes 40, 60, and 90 may include the first end and its vicinity inclined such that the each electrode is disposed along a plane including the axis O, and such that the discharge gap is formed between the first end of the each electrode and the front end section 14. In another manner, in contrast to such configuration that each electrode of the ground electrodes 40, 60, and 90 is disposed to be included by the plane including the axis O, each electrode of the ground electrodes 40, 60, and 90 may be disposed skew with respect to the axis O.

Although according to the embodiments each electrode of the ground electrodes 40, 60, and 90 is formed linearly, the present invention is not limited to that. Each electrode of the ground electrodes 40, 60, and 90 may be shaped to be curved. The curved shape of each electrode allows each electrode to be disposed more freely.

According to the second embodiment, the size of discharge gap increases in the order of the discharge gaps 67, 70, 73, and 76: i.e., in the order from the rear end side to the front end side of the spark plug 50. According to the third embodiment, the size of discharge gap decreases in the order of the discharge gaps 97, 100, 103, and 106: i.e., in the order from the rear end side to the front end side of the spark plug 80. However, the present invention is not limited to that. It is not necessary to arrange the discharge gaps in order of size in the axial direction. For example, by forming at least one front-end-side discharge gap that is positioned forward with respect to one rear-end-side discharge gap and is larger than the rear-end-side discharge gap, it is allowed to facilitate the growth of flame in the front-end-side discharge gap nearer to the center of the combustion chamber than the rear-end side discharge gap. In another manner, by forming at least one front-end-side discharge gap that is positioned forward with respect to one rear-end-side discharge gap and is smaller than the rear-end-side discharge gap, it is allowed to facilitate the generation of initial flame in the front-end-side discharge gap nearer to the center of the combustion chamber than the rear-end side discharge gap.

Although according to the second or third embodiment the four ground electrodes 60 or 90 are arranged at equal intervals in the circumferential direction, the present invention is not limited to that. The circumferential intervals of the ground electrodes may be appropriately modified.

What is claimed is:

1. A spark plug comprising:

a central electrode extending from a front end side to a rear end side along an axis;

an insulator including a front end section formed to be a bottomed tube surrounding a tip of the central electrode;

a metal shell shaped to be tubular and structured to support the insulator such that the front end section of the insulator projects to the front end side from a front end section of the metal shell; and a plurality of ground electrodes each of which includes a first end forming a discharge gap with the front end section of the insulator and includes a second end connected to the front end section of the metal shell, wherein the plurality of ground electrodes include a pair of ground electrodes different from each other in size of their discharge gaps.

2. The spark plug as claimed in claim 1, wherein any pair of ground electrodes out of the plurality of ground electrodes are different from each other in size of their discharge gaps.

3. The spark plug as claimed in claim 1, wherein the pair of ground electrodes different from each other in size of their discharge gaps are different from each other in position of their first ends in a direction of the axis.

4. The spark plug as claimed in claim 3, wherein the discharge gaps include a pair of discharge gaps formed such that a front-end-side one of the pair of discharge gaps is larger than a rear-end-side one of the pair of discharge gaps.

5. The spark plug as claimed in claim 3, wherein the discharge gaps include a pair of discharge gaps formed such that a front-end-side one of the pair of discharge gaps is smaller than a rear-end-side one of the pair of discharge gaps.

6. The spark plug as claimed in claim 1, wherein the pair of ground electrodes different from each other in size of their discharge gaps are arranged such that the first ends of the pair of ground electrodes are apart from each other by 80° or greater in angle around the axis.

7. The spark plug as claimed in claim 1, wherein the plurality of ground electrodes are composed of two electrodes.

* * * * *